US006187526B1

(12) United States Patent
Paris et al.

(10) Patent No.: US 6,187,526 B1
(45) Date of Patent: Feb. 13, 2001

(54) METHOD TO PREVENT THE GROWTH OF MICRO-ORGANISMS IN PHOTOGRAPHIC DISPERSIONS

(75) Inventors: Christian Paris, Chatenoy le Royal; Laurent G. Fernandez-Puente, Chalon sur Saone, both of (FR)

(73) Assignee: Eastman Kodak Company, Rochester, NY (US)

( * ) Notice: Under 35 U.S.C. 154(b), the term of this patent shall be extended for 0 days.

(21) Appl. No.: 09/443,014

(22) Filed: Nov. 18, 1999

(30) Foreign Application Priority Data

Dec. 3, 1998 (FR) ..... 9815457

(51) Int. Cl.[7] ..... G03C 1/08; G03C 7/26; G03C 7/32

(52) U.S. Cl. ..... 430/546; 430/543; 430/377; 430/449

(58) Field of Search ..... 430/543, 546, 430/377, 449

(56) References Cited

U.S. PATENT DOCUMENTS

| | | | |
|---|---|---|---|
| 3,396,027 | 8/1968 | McFall et al. . | |
| 4,075,022 | 2/1978 | Van Wignsberghe | 430/359 |
| 4,224,403 | 9/1980 | Toda et al. . | |
| 4,490,462 | 12/1984 | Kawaguchi et al. . | |
| 4,997,752 | 3/1991 | Sasaki et al. . | |
| 5,055,381 * | 10/1991 | Abe et al. | 430/546 |
| 5,059,516 | 10/1991 | Sato et al. . | |
| 5,153,116 | 10/1992 | Metoki et al. . | |
| 5,346,809 | 9/1994 | Takada et al. . | |
| 5,726,003 | 3/1998 | Zengerle et al. | 430/546 |

FOREIGN PATENT DOCUMENTS

| | | |
|---|---|---|
| 331 319 | 1/1994 | (EP) . |
| 0 429240 | 3/1996 | (EP) . |
| 4177239 | 6/1992 | (JP) . |

OTHER PUBLICATIONS

Research Disclosure No. 36544, Sep. 1994, Kenneth Mason Publication, Ltd., Dudley House, 12 North Sreet, Emsworth, Hampshire P010 7DQ, England.
Japanese Abstract 9329862.
Japanese Abstract 10011739.
Japanese Abstract 9133977.
Japanese Abstract 2843867.
Research Disclosure No. 37026, vol. 370, Feb. 1995.

* cited by examiner

*Primary Examiner*—Geraldine Letscher
(74) *Attorney, Agent, or Firm*—Sarah Meeks Roberts

(57) ABSTRACT

The invention relates to the preparation of photographic dispersions.

The method of the invention consists in preparing a fluid dispersion of an additive in a colloid, congealing the resulting dispersion, subdividing the resulting congealed dispersion into particles, washing the resulting particles, and adding to them a solution of biocide.

A dispersion is thus obtained that is protected against the proliferation of micro-organisms during storage.

7 Claims, No Drawings

METHOD TO PREVENT THE GROWTH OF MICRO-ORGANISMS IN PHOTOGRAPHIC DISPERSIONS

FIELD OF THE INVENTION

This invention relates to color photography, and more particularly to a method to prevent the growth of micro-organisms in dispersions used to incorporate additives, in particular couplers, in silver halide photographic materials.

BACKGROUND OF THE INVENTION

In practice, color images are obtained by exposing silver halides layers, and then developing these layers using developing agents of the paraphenylenediamine type. When these agents are oxidized, in proportion to the development of the silver halides, they react with couplers to form dyes of the azomethane type. Each layer of emulsion in a color photographic material is associated with a coupler that by reaction with an oxidized paraphenylenediamine will produce a primary subtractive color, yellow, magenta or cyan, complementary to the area of sensitivity of the emulsion layer (blue, green or red, respectively). The couplers are added to the emulsion layers or to adjacent layers as solutions in heavy or oily solvents with high boiling point, dispersed in hydrophilic colloids such as gelatin or gelatin derivatives, for example phthalylated gelatin.

Additives other than couplers, for example dyes, or substituted hydroquinones such as dioctyl hydroquinone, can be added to the photographic layers by the same method. These conventional methods for the inclusion of additives are disclosed in Research Disclosure, publication 36544, September 1994, page 527.

The incorporation of some additives, such as couplers, requires auxiliary solvents that are useful during the preparation of the dispersion, but which have subsequently to be removed by any of various known means. This invention relates to dispersions in which the auxiliary solvents are removed by washing.

In general, the introduction of additives involves:

- preparation of a fluid dispersion in the high boiling point solvent, the hydrophilic colloid and an auxiliary solvent;
- congealing and subdivision of the chilled dispersion to obtain a high contact surface area, and the washing of this dispersion to remove the auxiliary solvent;
- storage of the washed subdivided congealed dispersion; and
- remelting of the dispersion for use in the preparation of a photographic layer.

Although the dispersion is stored at low temperature (below 10° C.), the presence of a hydrophilic colloid of the gelatin type favors the proliferation of micro-organisms. Such microbial growth, which is especially prevalent in summer, can spoil whole batches of dispersion. To prevent such spoilage, biocides and anti-bacterial agents have been employed. However, the use of such biocides meets the following difficulty: the biocide can be added at the time of the preparation of the dispersion, when this is fluid, but it is liable to be removed at the washing stage, leaving the dispersion unprotected during storage. If the biocide is added after washing, the dispersion has to be remelted specially for that purpose. Addition of a further step to an already complex process is not desirable.

SUMMARY OF THE INVENTION

It is an object of this invention to provide a method to prevent the growth of micro-organisms in dispersions intended for the preparation of photographic materials. It is another object of this invention to provide a method which unexpectedly allows the biocide to be permanently incorporated in the subdivided chilled dispersion with no additional remelting step being required.

According to this invention the above objects are met by providing a method which comprises the steps of:

(1) forming a fluid dispersion that comprises a hydrophilic colloid, a high-boiling solvent, an auxiliary solvent and a photographic reagent;

(2) chilling, dividing and washing the dispersion to remove the auxiliary solvent from the dispersion.

(3) Additing an aqueous solution of at least one biocide to the washed chilled dispersion.

DETAILED DESCRIPTION OF THE INVENTION

The biocides used in this invention are hydrophilic compounds soluble in water or aqueous solvents. Aqueous solvents are here defined as mixtures containing predominantly water (more than 80% and preferably more than 90%), together with other hydrophilic constituents such as alcohols, glycols, or surfactants. Biocides meeting this criterion include for example isothiazolones, such as N-alkylisothiazolones, dithiocarbamates, the sodium salt of 1 -hydroxypyridine-2-thione, N-alkyl-4-isothiazolidones, and chlorobenzenesulfonates. The concentration of the biocides is adjusted to prevent the proliferation of micro-organisms but without adversely affecting the properties of the photographic materials.

The biocides are generally used in small amounts, from 5 to 50 ppm or more according to the biocide selected, based on the mass of the dispersion. In practice, the biocide is added in the form of a few ml of a dilute solution of biocide per kg of dispersion. In step (2) of the method, the chilled and solidified dispersion is divided into particles or noodles to obtain a large contact surface area allowing efficient washing and subsequent impregnation by the biocide solution. This division can be achieved by extruding the chilled dispersion through a perforated plate, to obtain noodles, or by any other appropriate means.

As indicated, once prepared, the dispersion comprises a permanent solvent with a high boiling point together with an auxiliary solvent, which is removed at the washing step. The auxiliary solvent is for example a solvent soluble in water, or that can be removed in an aqueous medium, and with a boiling point between 70 and 250° C., for example beta-ethoxyethyl acetate, ethyl acetate, ethyl propionate, butoxyethoxyethyl acetate, and solvents such as those defined in U.S. Pat. No. 2,949,360.

The high-boiling solvent (having a boiling point higher than about 200° C.) is for example tricresyl phosphate, dibutyl phthalate, triphenyl phosphate, n-butyl phthalate, or high-boiling point solvents of the crystalloidal type. References concerning high boiling point solvents include for example U.S. Pat. Nos. 2,322,027, 2,801,170, 3,748,141.

EXAMPLE

A dispersion was prepared in the following way: 100 g of a yellow color forming coupler with the following formula were dissolved at 115° C. and with stirring in 25 g of di-n-butyl phthalate and 100 g of 2-(2-butoxyethoxy)ethanol acetate:

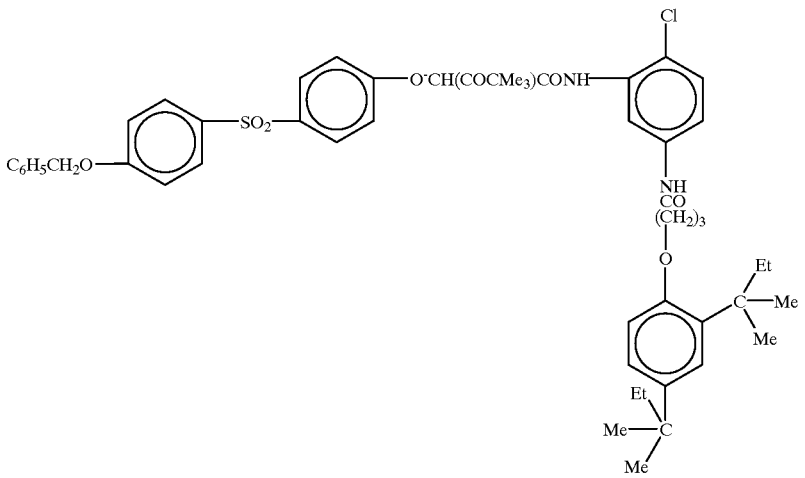

A separate solution was prepared, containing:

75 g of ordinary gelatin, 458 g of osmosed water, to which was added enough acetic acid to adjust the pH to 5.8, and 66 g of a surfactant (DuPont Alkanol XC®).

The solution of coupler was poured into the gelatin solution with stirring, and the resulting mixture was homogenized in a blender to obtain a homogeneous dispersion. The dispersion was then cooled and chilled, divided into solidified particles by extrusion, and washed in water acidified to pH =5.5 for 4 hours to remove the 2-(2-butoxyethoxy)-ethanol acetate.

60 kg of this chilled and washed dispersion were placed in a Vrieco-Nauta DBXE 200 R/W mixer. 2.14 ml/kg of a dispersion of a solution of 7 g/l of biocide Kathon® (Rohm & Haas) in osmosed water was added, with stirring at 100 rpm. After the addition was complete, stirring was continued for several minutes.

In practice, owing to its division into particles, the gelatin was able to absorb the biocide solution by impregnation, because the solution of biocide was not merely percolating intact through the particles to the bottom of the reactor.

The quantity of biocide added represented a theoretical content of 15 ppm of biocide in the dispersion.

Since the purpose was to achieve a homogeneous addition of biocide to the dispersion to obtain a homogeneous protection, a series of samples of the dispersion were taken from successive horizontal sections in the mixer and the concentration of biocide was measured in each sample.

The following results were obtained.

TABLE I

| Sample number | Measured biocide content (ppm) | % of theoretical value |
|---|---|---|
| 1 | 12.8 | 85 |
| 2 | 13.0 | 87 |
| 3 | 12.8 | 85 |

TABLE I-continued

| Sample number | Measured biocide content (ppm) | % of theoretical value |
|---|---|---|
| 4 | 12.3 | 82 |
| 5 | 12.6 | 84 |
| average | 12.7 | 84 |
| deviation | 0.26 | 1.8 |

1—that the quantity of biocide retained was normal relative to the quantity added, as some of the biocide is destroyed by the gelatin, and 2—that the range of variation within the batch of treated dispersion was narrow.

What we claim is:

1. A method of preparing a photographic dispersion, said method comprising the steps of:

(1) forming of a fluid dispersion containing a hydrophilic colloid, a photographic reagent, a high-boiling solvent and an auxiliary solvent;

(2) chilling, divising and washing the dispersion; and (3) Adding to the chilled and washed dispersion an aqueous solution of at least one biocide.

2. The method of claim 1 wherein the dispersion in step (2) is chilled and divided into particles or noodles.

3. The method of claim 1 wherein the dispersion contains gelatin or a derivative of gelatin.

4. The method of claim 1, wherein the photographic reagent is a coupler.

5. The method of claim 1, wherein the biocide is an isothiazolone compound.

6. The method of claim 1, wherein the biocide is a mixture of two isothiazolone compounds.

7. The method of claim 6, wherein the biocide comprises an N-alkylisothiazolone.

* * * * *